US011981410B2

(12) United States Patent
Van Diepen

(10) Patent No.: US 11,981,410 B2
(45) Date of Patent: May 14, 2024

(54) STERN BULBS

(71) Applicant: Peter Van Diepen, Vancouver (CA)

(72) Inventor: Peter Van Diepen, Vancouver (CA)

( * ) Notice: Subject to any disclaimer, the term of this patent is extended or adjusted under 35 U.S.C. 154(b) by 293 days.

(21) Appl. No.: 17/396,543

(22) Filed: Aug. 6, 2021

(65) Prior Publication Data

US 2023/0043247 A1 Feb. 9, 2023

(51) Int. Cl.
*B63H 1/28* (2006.01)

(52) U.S. Cl.
CPC ..... *B63H 1/28* (2013.01)

(58) Field of Classification Search
CPC ... B63H 1/28; B63H 1/08; B63H 5/08; B63H 5/16
See application file for complete search history.

(56) References Cited

U.S. PATENT DOCUMENTS

| | | | |
|---|---|---|---|
| 2,729,182 | A | 1/1956 | Tommasi |
| 3,180,299 | A | 4/1965 | Inui |
| 3,416,480 | A | 12/1968 | Pien |
| 3,540,400 | A | 11/1970 | Boston |
| 4,538,537 | A | 9/1985 | Nonnecke |
| 4,550,673 | A | 11/1985 | Ingvason |
| 4,843,989 | A | 7/1989 | Langenberg |
| 8,499,705 | B2 | 8/2013 | Matsumoto |
| 9,073,615 | B2 | 7/2015 | Kokkila |
| 9,180,933 | B1 | 11/2015 | Karafiath et al. |
| 9,527,551 | B2 | 12/2016 | Moving |
| 2016/0347417 | A1 | 12/2016 | Matsumoto |

FOREIGN PATENT DOCUMENTS

| | | | |
|---|---|---|---|
| CA | 1237607 | 6/1988 | |
| CN | 88104787.6 | 3/1988 | |
| CN | 106080951 | 11/2018 | |
| GB | 1497121 | 8/1975 | |
| JP | 62163895 | 7/1987 | |
| JP | 2011168238 | 9/2011 | |
| WO | WO-03095302 A1 * | 11/2003 | ..... B63H 23/34 |
| WO | 2005012075 | 2/2005 | |
| WO | 2014118595 | 7/2014 | |
| WO | 2018138941 | 2/2018 | |

* cited by examiner

*Primary Examiner* — Anthony D Wiest
(74) *Attorney, Agent, or Firm* — Richard D. Okimaw

(57) ABSTRACT

In a marine vessel, a propulsion system comprises at least one propeller having a direction of rotation about a drive shaft and a bulbus protrusion extending from the hull associated with each of the at least one propeller, each protrusion extending from the hull of the vessel, each protrusion receiving and rotatably supporting the at least one propeller. Each protrusion extends between leading and trailing ends and has a substantially circular cross section along a length between the leading and trailing ends having and a leading portion extending from the leading end wherein the leading portion is angled away from the centerline of the hull.

13 Claims, 4 Drawing Sheets

STERN BULBS

BACKGROUND

1. Technical Field

This disclosure relates generally to marine vessels and in particular to a propeller supporting stern bulb.

2. Description of Related Art

In modern naval design, propellers are the most common means of propulsion for ships and other vessels. Most commonly such propellers are located at the stern or rear of the hull. One of the primary goals in designing both hulls and propellers is to improve propeller efficiency, namely the percentage of power deliver to a propeller that results in its thrust, or force that propels the ship through water. Some efforts to address this goal have been focused on the propeller itself including the shape of its blades, and even of its hub.

Other efforts concentrated on improving the flow into propeller, which significantly affect its efficiency, especially three of its parameters: its velocity, axial distribution of its velocity and radial distribution of its velocity.

Propeller efficiency and its associated thrust is affected by several characteristics of the water flowing into and around the propeller. In particular, it is known that the efficiency and thrust is the highest when the water flowing there past is moving slowest (known as bollard pull). As flow velocity increases, efficiency and thrust of the propeller decreases. Thus designers often attempt to slow velocity of water flow into the propeller as much as possible to optimize thrust and efficiency.

Furthermore, it is also known that the axial distribution of the flow of water into the propeller affects the efficiency. In particular, obstructions to the flow, such as struts supporting shaft in an open shaft arrangement, or skegs in an arrangement of the shaft enclosed in a tapered stern or stern bulb or bulbs, will locally slow down velocity of the flow. As blades of the propeller pass through higher and lower velocity of the flow, at the typical rate of 100 to 300 per minute, the thrust they produce will vary, producing unwelcome vibrations and reductions in efficiency. Finally, the rotation of the water flow into the propeller also affects the thrust and efficiency of the propeller. In particular, if the flow rotates in a direction opposite to propeller rotation, it has the same effect as lower velocity of the flow, increasing propeller efficiency.

Previous attempts have been made to rotate the flow of water into the propeller to cause an increase in efficiency and thrust. In particular, fins have been fitted to the hull forward of the propeller which rotate the flow in the desired direction. However the effectiveness of such fins has been limited.

Similarly, counter-rotating propellers, in which the second propeller on the common shaft would rotate against the flow generated by the first propeller have also been provided. Such solutions are however complex and prone to mechanical failure and may also produce severe vibrations.

SUMMARY OF THE DISCLOSURE

According to a first embodiment, there is disclosed a propulsion system for a vessel having a hull extending a long a centerline between a bow, a stern and starboard and port sides, the propulsion system comprising at least two propellers each having a direction of rotation about a drive shaft and a bulbus protrusion extending from the hull associated with each of the at least two propellers, each protrusion extending from the hull of the vessel, each protrusion receiving and rotatably supporting one of the at least two propellers. The protrusion extending between leading and trailing ends has a substantially circular cross section along a length between the leading and trailing ends having a leading portion extending from the leading end wherein the leading portion is angled away from the centerline of the hull.

The leading portion may be angled relative to the centerline of the hull by an angle selected to be between 5 and 25 degrees. The leading portion may taper toward the leading end. The leading portion may taper along a constant angle.

The protrusion may further comprise a main portion extending from the trailing end to the leading portion. The leading portion may be angled relative to the centerline at an angle selected to be between 5 degrees toward the centerline and 25 degrees away from the centerline. The protrusion may include a trailing portion extending from the trailing end and a middle portion between the leading and trailing portions.

The trailing portion may taper towards the trailing edge. The trailing portion may taper along a constant angle. The drive shaft may extend from the trailing end of the trailing portion.

The at least two propellers may be arranged in pairs with their protrusions having leading edges angled away from each other and the centerline of the hull. The pairs may be arranged with inward rotation.

According to a further embodiment, there is disclosed a water vessel comprising a hull extending a long a centerline between a bow, a stern and starboard and port sides at least two propellers each having a direction of rotation about a drive shaft rotatably supported below the hull and a bulbus protrusion extending from the hull associated with each of the at least two propellers, each protrusion extending from the hull of the vessel, each protrusion receiving and rotatably supporting the at least one propeller. The protrusion extends between leading and trailing ends and has a substantially circular cross section along a length between the leading and trailing ends having and a leading portion extending from the leading end wherein the leading is angled away from the centerline of the hull.

Other aspects and features of the present disclosure will become apparent to those ordinarily skilled in the art upon review of the following description of specific embodiments in conjunction with the accompanying figures.

BRIEF DESCRIPTION OF THE DRAWINGS

The accompanying drawings constitute part of the disclosure. Each drawing illustrates exemplary aspects wherein similar characters of reference denote corresponding parts in each view.

DETAILED DESCRIPTION

Aspects of the present disclosure are now described with reference to exemplary apparatuses, methods and systems.

Figure 1:
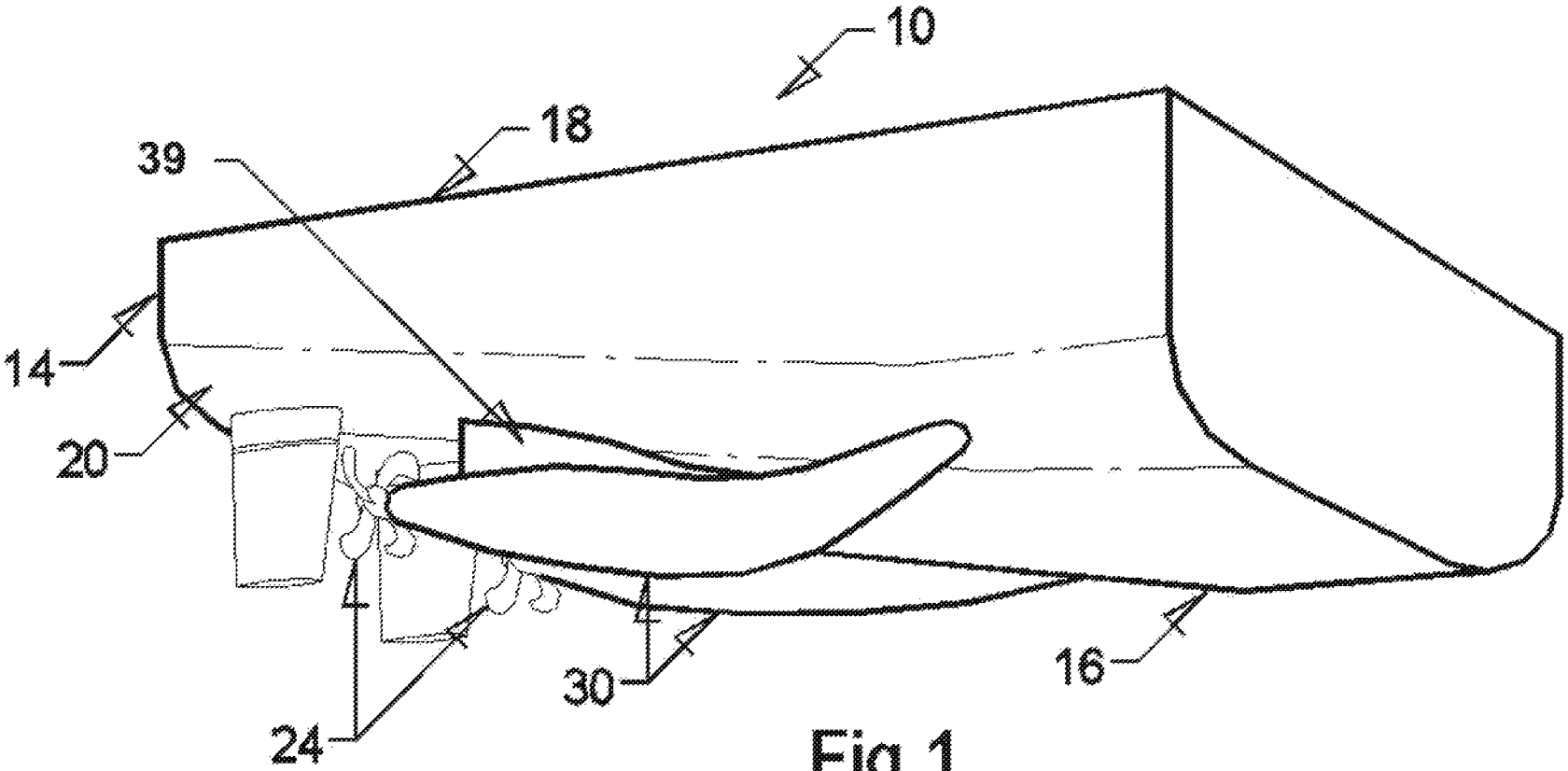
FIG. 1 is a perspective view of a water vessel according to a first embodiment.

Referring to FIG. 1, an exemplary ship hull according to a first embodiment is shown generally at 10. The hull 10 extends between bow (not illustrated) and stern ends 14, respectively and port and starboard sides, 16 and 18, respectively as is commonly known. The hull 10 includes a bottom portion 20 which is located below the water level of the body of water in which it is operated. The hull 10 may optionally include a skeg 22 extending along the centerline 25 of the vessel.

As illustrated herein the hull 10 includes one or more protrusions 30 extending from the bottom portion 20 of the hull. Each protrusion 30 supports a propeller 24 from a shaft 26. The shaft 26 is supported in the protrusion by conventional means and may include any associated equipment for rotating and powering the propellers including, without limitation, gears, motors, bearings and the like.

Figure 2:
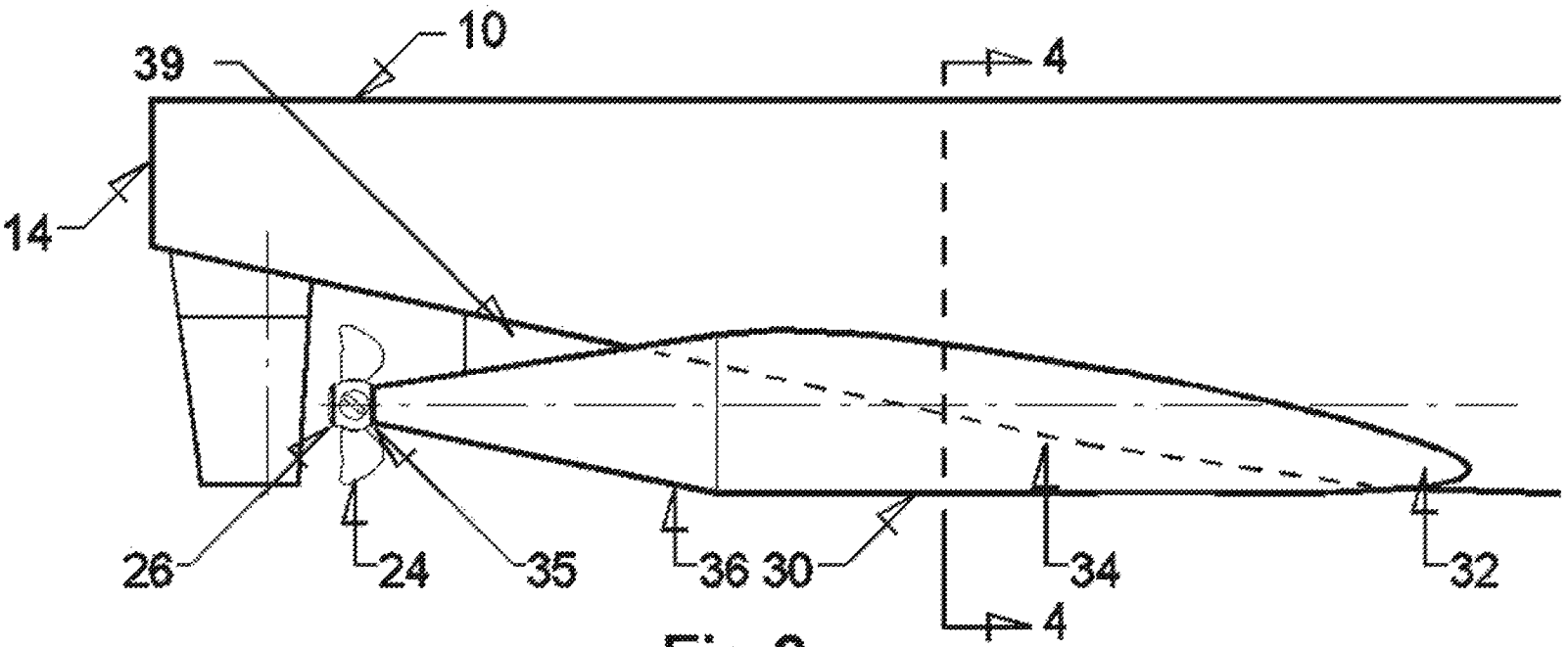
FIG. 2 is a side view of the vessel of FIG. 1.
Figure 3:
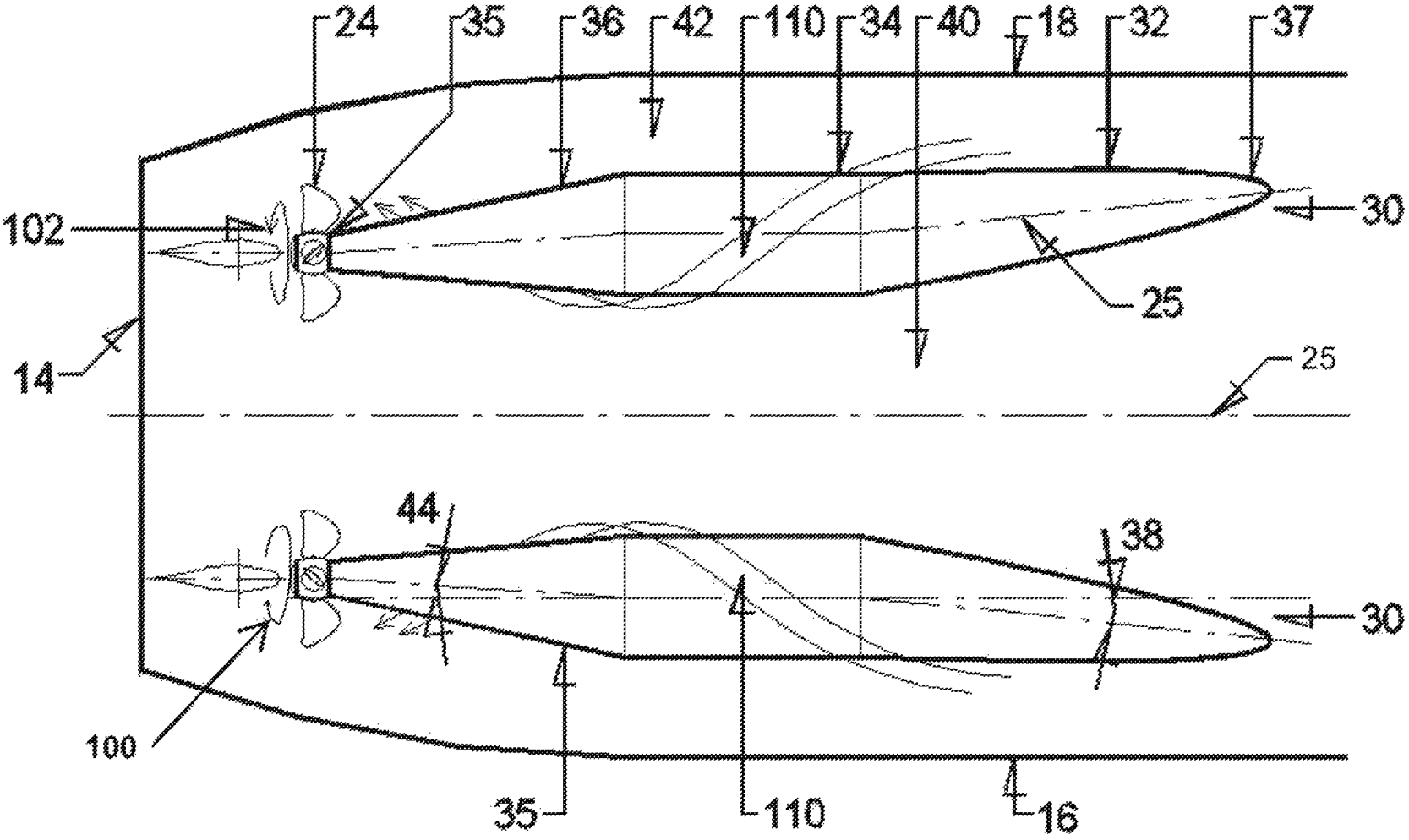
FIG. 3 is a bottom plan view of the vessel of FIG. 1.

The protrusion 30 comprises a bulbous body extending from the bottom 30 portion 20 of the hull 10. Turning now to FIGS. 2 and 3, the protrusions 30 include a leading portion 32 oriented towards the bow, a trailing portion 36 oriented towards the stern 14 and an optional middle portion 34 therebetween. As illustrated in FIG. 3, each leading portion 32 is angled away from the centerline 24 of the hull 10 by a leading angle 38. The leading angle is selected to cause an increase in pressure in a region to one side of the protrusion and a lower pressure region to the other. In particular as illustrated in FIG. 3, the region between the protrusions, generally indicated at 40 will have a greater water pressure generated therein than to the regions outside of the protrusions 30, generally indicated at 42. The difference in pressure between these regions will cause a movement of water around the protrusions along the surface thereof between the interior region 40 and the outer regions. This movement of water, generally indicated at 110 creates a rotational direction of the water (indicated at 110) entering the propellers 24 counter to their direction of rotation thereby increasing efficiency and thrust of the propellers. In practice it has been found that a leading angle 38 of between 5 and 25 degrees has been useful, however it will be appreciated that other angles may also be utilized depending on the shape of the hull 10. In addition, although the protrusions are illustrated as substantially straight in the Figures, non-straight profiles, such as by way of non-limiting example, curved may also be utilized.

In marine architecture, it is well known that the direction of rotation for a propeller is referred to as right-handed when the propeller is rotating in a clockwise direction when viewed from the stern of the vessel. Similarly, the rotation is referred to as left-handed when the propeller is rotating in a counter-clockwise direction when viewed form the stern of the vessel. As utilized herein, the terms right-handed and left-handed will refer to such conventional definitions. Relatedly, when arranged in pairs, propellers are frequently referred to by the relative rotation of the propellers to each other. In particular, propellers in which the right-hand propeller (when viewed from the stern) has a right-hand rotation and the left hand propeller has a left hand rotation is commonly referred to as outward rotation. Inward rotation is commonly defined as when the right hand propeller has a left-hand rotation an the left-hand propeller has a right-hand rotation such that their upper tips rotate towards each other. The propellers would include the left hand rotating propeller to the right of the right hand rotating propeller when viewed from the stern. As described and illustrated herein, the pairs of propellers will be arranged with inward rotation in which, the propeller towards starboard side of the vessel with have a left-handed rotation, indicated at 100. Similarly, the propeller towards the port side will have a right-handed rotation, indicated at 102.

As illustrated in FIGS. 2 and 3, the protrusions 30 also include trailing portions 36 and an optional middle portion 34. The trailing portion 36 ends at a trailing end 35 of the protrusion opposite to the leading end 37 of the protrusion. The trailing portion 36 may be angled along the horizontal relative to the centreline 24 of the hull 10 by a trailing angle generally indicated at 44. The trailing angle 44 is utilized to control or adjust the relative rotational flow of the water entering the propeller and may be selected to be between 5 degrees in the opposite direction to the leading angle 38 and 10 degrees in the same direction as the leading angle 38. As illustrated in FIG. 2, the trail end 35 of the protrusion may also be separated from the hull so as to permit the water to flow completely therearound reducing vibration due to pressure variation. Optionally, a portion of the protrusion 30 including, such as part of the trailing portion 36 may be connected to the hull 10 by a skeg 39 as illustrated in FIGS. 1 and 2. The skeg 39 may be aligned with the trailing portion 36 at a similar trailing angle 44 or may optionally be aligned at a different angle than the trailing portion 36 relative to the centreline 24 of the hull. In particular, the trailing angle 44 may be adjusted to maximize the rate of flow rotation around the protrusion. The middle portion 34 may optional be oriented parallel to the centreline 24 of the hull or at any other orientation therebetween.

Figure 4:
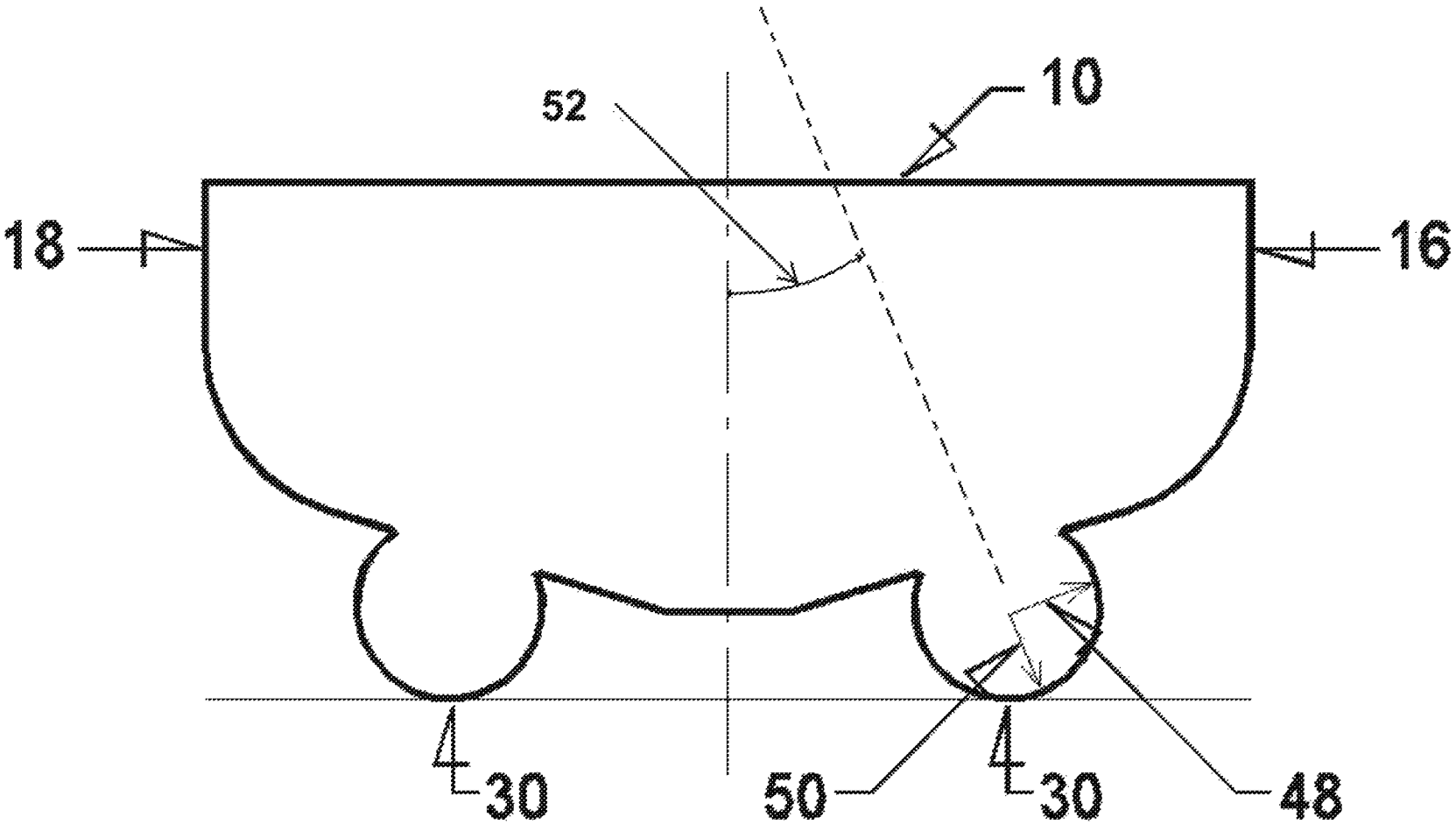
FIG. 4 is a cross sectional view of the vessel of FIG. 1 as taken along the line 4-4.

Turning now to FIG. 4, a cross-sectional view of the hull 10 and protrusions 30 is illustrated. As illustrated, each protrusion has a generally circular cross-section so as to permit flow of water radially therearound. The profile of each protrusion may be defined as having two orthogonal radiuses, 48 and 50 wherein the two radiuses are within 90 of each other. In such manner, it will be observed that variations from circular will be useful such as by way of non-limiting example up to 10% of each other. Similarly, the protrusions 30 will be connected to the hull such that the an angle 52 of the profile is extended below the hull 10. As illustrated, the angle 52 may be selected depending on the shape of the hull to which is applied such as by way of non-limiting example between 0 degrees and 180 degrees.

While specific embodiments have been described and illustrated, such embodiments should be considered illustrative only and not as limiting the disclosure as construed in accordance with the accompanying claims.

What is claimed is:

1. A propulsion system for a vessel having a hull extending along a centerline between a bow, a stern and starboard and port sides, the propulsion system comprising:

at least two propellers each having a direction of rotation about a drive shaft; and a bulbus protrusion extending from the hull associated with each of the at least two propellers, each protrusion receiving and rotatably supporting one of the at least two propellers, the protrusion extending between leading and trailing ends and having:

a substantially circular cross section along a length between the leading and trailing ends having; and a leading portion extending from the leading end wherein the leading portion is angled away from the centerline of the hull relative to a main portion of the protrusion.

2. The propulsion system of claim 1 wherein the leading portion is angled relative to the centerline of the hull by an angle selected to be between 5 and 25 degrees.

3. The propulsion system of claim 1 wherein the leading portion tapers towards the leading end.

4. The propulsion system of claim 1 wherein the leading portion tapers along a constant angle.

5. The propulsion system of claim 1 wherein the main portion extends from the trailing end to the leading portion.

6. The propulsion system of claim 5 wherein the leading portion is angled relative to the centerline at an angle selected to be between 5 degrees toward the centerline and 10 degrees away from the centerline.

7. The propulsion system of claim 6 wherein the protrusion includes a trailing portion extending from the trailing end and a middle portion between the leading and trailing portions.

8. The propulsion system of claim 7 wherein the trailing portion tapers towards the trailing edge.

9. The propulsion system of claim 8 wherein the trailing portion tapers along a constant angle.

10. The propulsion system of claim 7 wherein the drive shaft extends from the trailing end of the trailing portion.

11. The propulsion system of claim 1 wherein in the at least two propellers are arranged in pairs with their protrusions having leading edges angled away from each other and the centerline of the hull.

12. The propulsion system of claim 11 wherein in the pairs are arranged with inward rotation.

13. A water vessel comprising:

a hull extending a long a centerline between a bow, a stern and starboard and port sides:

at least two propellers each having a direction of rotation about a drive shaft rotatably supported below the hull; and a bulbus protrusion extending from the hull associated with each of the at least two propellers, each protrusion extending from the hull of the vessel, each protrusion receiving and rotatably supporting one of the at least one propeller, the protrusion extending between leading and trailing ends and having:

a substantially circular cross section along a length between the leading and trailing ends having; and a leading portion extending from the leading end wherein the leading portion is angled away from the centerline of the hull relative to a main portion of the protrusion.

* * * * *